United States Patent [19]

Tuthill

[11] Patent Number: 4,496,088

[45] Date of Patent: Jan. 29, 1985

[54] TOOL HOLDER

[76] Inventor: Frederick W. Tuthill, 7601 Park Place Blvd., Houston, Tex. 77087

[21] Appl. No.: 543,827

[22] Filed: Oct. 20, 1983

[51] Int. Cl.[3] ..... A45C 11/00

[52] U.S. Cl. ..... 224/253; 224/232; 224/250; 224/904

[58] Field of Search ..... 224/253, 232, 234, 252, 224/250, 249, 904

[56] References Cited

U.S. PATENT DOCUMENTS

| | | | |
|---|---|---|---|
| 3,938,717 | 2/1976 | Theodore | 224/253 X |
| 4,253,593 | 3/1981 | Pattermann | 224/232 X |
| 4,264,024 | 4/1981 | Harris, Jr. | 224/250 |
| 4,408,706 | 10/1983 | Hurley | 224/904 X |

*Primary Examiner*—Steven M. Pollard

*Attorney, Agent, or Firm*—Ned L. Conley; David A. Rose; William E. Shull

[57] ABSTRACT

A plier sheath having an open end pocket for receiving and supporting a pair of pliers. The pocket is formed by folding over and by interconnecting the lower side portions of a flexible sheath panel. The plier sheath can be permanently or removably attached to a knife sheath in a superimposing fashion by fastener elements. The plier sheath may also be removably attached to a person's clothing item such as a belt with a loop disposed at the upper back portion of a plier sheath, through which the belt may be placed.

7 Claims, 4 Drawing Figures

TOOL HOLDER

BACKGROUND OF THE INVENTION

This invention relates to a tool holder and more particularly to a plier sheath which may be removably attached to a knife sheath or may be removably attached to a person's belt.

Outdoor sportsmen in general, and hunters and fishermen in particular, use such equipment as knives and pliers when they pursue their recreational interests. It is common for a hunter whether he is out in the forest, on a ranch, a lake or a river hunting wild animals or birds to use a knife or pliers in connection with his hunting. Furthermore, it is common for a fisherman, whether he is fishing from a boat, from a pier or wading in water, to have a need for a knife or a pair of pliers. Presently, hunters and fishermen and outdoor sportsmen in general carry knives in sheaths attached to their belts. However, pliers are typically carried in boxes or in other receptacles which are not convenient or readily accessible. Thus, when a hunter needs pliers to repair his equipment while he is out in the field he either has to leave his stalking or hiding place in order to retrieve his tool box or he has to search through his pockets or a tool box that he carries to fine the pliers. During that process he creates noise and loses valuable time causing his targets to run or fly away before he has the opportunity to shoot them. Moreover, a fisherman sometimes has a greater need for pliers in order, for example, to make repairs to his rod, reel or other tackle or in order to remove hooks from large, often uncooperative and possibly dangerous fish. Therefore, he is at a great disadvantage if he has to fumble through his tackle box or through his pockets or if he has to travel to where his tool box is located every time he catches a fish necessitating use of pliers or every time that he needs to make repairs. This disadvantage is more pronounced in the case of wade fishermen who often find themselves in water waist-deep or deeper. It is very impractical and very inconvenient for a wade fisherman to carry his tool box with him, to carry his pliers in his pockets, or to leave the water in search of his pliers every time that he needs to use them. Therefore, there has been a need for a device enabling outdoor sportsmen such as hunters and fishermen to carry their pliers along with their knives and to have those pliers readily accessible and available for use as and when the need arises.

Tool carriers removable attached to the user's belt are known. Such tool carriers are discussed in U.S. Pat. Nos. 755,009; 1,088,406; 2,500,257; 2,664,231; 2,758,798; 3,130,883; 3,239,057; 4,006,851; and 4,047,650. Furthermore, as disclosed in U.S. Pat. Nos. 1,088,406; 2,664,231; and 2,758,798 plier sheaths removably attached to the belt are also known. One drawback of these prior art plier sheaths is that by being directly attached to the belt they occupy a portion of the belt by themselves, thus limiting the belt space available for other usages and causing crowding and inconvenience.

In the prior art attempts were made to develop a multiple tool carrier to avoid the multiple belt attachments and to reduce tool crowding. U.S. Pat. No. 2,758,798 discloses a multiple tool carrier which includes various socket-like members which are removably attached to a large flat member. The socket-like members vary in size and, therefore, the carrier can be used to carry tools of different sizes according to the needs of the individual. The large flat member is attached to the belt. One difficulty with this carrier is that the socket-like elements that support the different tools are individually and directly attached to the larger flat member and, therefore, they are spread out forming a large overall multiple tool carrier which is very inconvenient. Another problem is that regardless of how few tools are carried or how small the tools are, the large back panel must be used. In addition, the individual sockets, though removable, do not have the capability of being directly attached to the belt.

U.S. Pat. No. 3,130,883 discloses a tool carrier attachable to a belt that may carry a hatchet and a knife. One difficulty is that because each tool is attached separately to a larger flat member, a large carrier that restricts the free movement of the individual is required. Another difficulty is that the whole tool carrier must be used regardless of whether there is only a need to carry one of the two tools.

U.S. Pat. No. 4,407,650 discloses a sportsman's multipurpose utility pouch which is combined with a knife sheath. The various pockets for the cartridges and other accessories and the knife sheath are spread horizontally on a large continuous flat panel which is attachable to the belt. This pouch has similar drawbacks, as compared to the previously disclosed multiple tool carriers. First, the pouch is large because of the attachment of each individual receptacle directly to the backing panel and because of the horizontal addition of the knife sheath. Also, its integral construction does not offer the capability of reducing the size of the tool carrier by moving certain receptacles when they are not in use. Specifically, because of the pouch's construction, one has to carry the knife sheath even though he does not have use for a knife.

The present invention eliminates the difficulties and drawbacks of the prior art by providing a plier sheath which may be attached, removably or non-removably, to a knife sheath which in turn may be removably attached to a belt. This feature makes the tool carrier smaller and more convenient to carry. Furthermore, a plier sheath is provided which not only may be removably attached to the knife sheath but it may also be removably attached to a belt. Therefore, the nuisance of carrying unnecessary tools is eliminated and the user of the present invention may choose, for example, to take with him the pliers only, leaving the knife behind in a safe place. In general, the present invention enables an outdoor sportsman to carry a pair of pliers and a knife in a convenient fashion so that he can fully enjoy his recreational interests and leisure time.

These and various other objects and advantages of the present invention will become readily apparent to those skilled in the art upon reading the following detailed description and claims and by referring to the accompanying drawings.

The above objects are attained in accordance with the present invention by the provision of an apparatus fabricated in a manner substantially as described in the above abstract and summary.

SUMMARY OF THE INVENTION

According to the invention there is provided a plier sheath which may be removably or permanently attached to a knife sheath. The plier sheath includes a flexible sheath panel, the lower side portions of the sheath panel being folded over and interconnected to form a pocket with an open bottom end for receiving and supporting a pair of pliers. Connecting means such as snap fasteners or rivets are provided for superimposingly connecting the sheath panel to the knife sheath. The plier sheath may also be directly and removably attached to a person's clothing item such as a belt with a loop disposed at the upper back portion of the plier sheath, through which the belt may be placed. The loop is closed by fastener elements on the back of the sheath panel.

According to the invention on outdoors sportsman such as a hunter or a fisherman may carry his pliers together which his knife in a tool carrier which is readily accessible and convenient to carry because of its superimposing tool arrangement. Furthermore, such a tool carrier enables the outdoor sportsman to carry either of the two tools when the other one is not needed without the burden and inconvenience of carrying around a bulky prior art multiple tool carrier. Other objects and advantages of the invention will appear from the following description.

BRIEF DESCRIPTION OF THE DRAWINGS

For a detailed description of the preferred embodiments of the apparatus of the present invention, reference will now be made to the accompanying drawings wherein.

DESCRIPTION OF THE PREFERRED EMBODIMENTS

Figure 1:
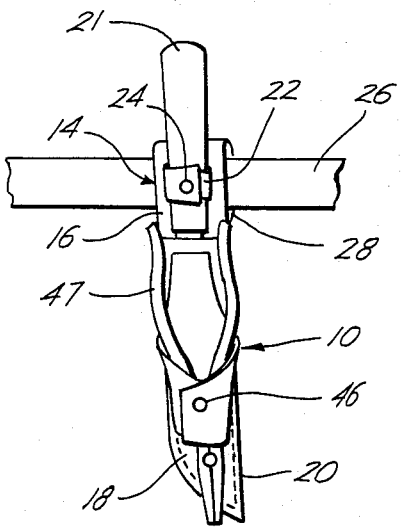
FIG. 1 is a front view of the plier sheath of the present invention attached to a knife sheath.

Referring initially to FIG. 1 there is shown a plier sheath 10 removably attached by snap fasteners (not shown) to a knife sheath 14. Knife sheath 14 has an integrally formed base portion 16 for receipt of sheath panel 18, secured thereto as by stitching 20. Sheath panel 18 thus secured to base portion 16 defines a pocket for receipt of hunting or fishing knife 21 or the like. A securing strap 22 is attached to the upper front portion of base portion 16 and is adapted to encircle the knife handle, with the ends of strap 22 being releasably interconnected by snap means 24 or the like. Knife sheath 14 is removably attached to belt 26, the top portion of base portion 16 forming a loop 28 around belt 26. Sheath panel 18 has on its outside surface a pair of male snaps (not shown) for removably attaching plier sheath 10 to sheath panel 18.

Figure 2:
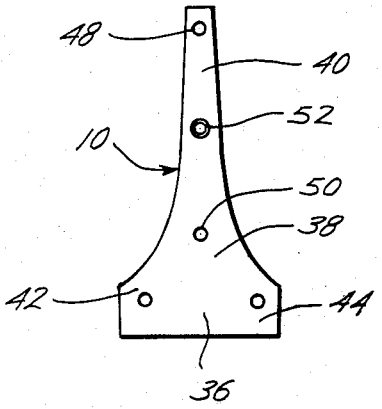
FIG. 2 is a front view of the plier sheath of the present invention in a flat position prior to assembly.

Referring now to FIG. 2, there is shown plier sheath 10 in an unassembled flat position to better illustrate its shape and its various parts. Plier sheath 10 comprises a sheath body of flexible material, such as leather, soft vinyl or other suitable material, having a lower, generally rectangular portion 36, an intermediate, generally triangular portion 38 extending upwardly from rectangular portion 36, and an upper, generally rectangular straplike portion 40 extending upwardly from portion 38. Side ends 42 and 44 of rectangulr portion 36 are folded over forwardly and inwardly to form a pocket for a pair of pliers 47 as shown in FIG. 1. Furthermore, as shown in FIG. 1, folded ends 42 and 44 are releasably or permanently interconnected by snap fastening or riveting means 46.

Figure 3:
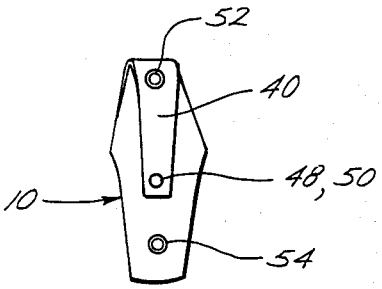
FIG. 3 is a rear view of the plier sheath of the present invention after assembly, and ready for attachment to a knife sheath or belt.

Referring now to FIG. 3, there is shown the back of plier sheath 10 in its assembled form. Strap-like portion 40 is folded over downwardly and rearwardly to form a loop, being locked to the looped position by rearwardly facing fastening snaps 48, 50 disposed on the upper end of portion 40 and approximately the center of portion 38, respectively, of the flat plier sheath 10, as shown in FIG. 2. With the loop so formed, the plier sheath 10 is adapted for attachment to knife sheath 14. Specifically, when straplike portion 40 is folded over and locked to the looped position by snaps 48, 50, female snap 52, which is shown in FIG. 2 on the front of portion 40, faces towards the back. In that position, female snap 52, and female snap 54 which is located on the back of rectangular portion 36 (FIG. 3), are ready for fastening engagement with a pair of corresponding, outwardly facing male snaps disposed on sheath panel 18 of knife sheath 14, as shown in FIG. 1. The direct attachment of plier sheath 10 to the outside of knife sheath 14 allows the sportsman to have both tools, i.e., the knife and pliers, readily available to him without the burden and inconvenience of carrying a large tool carrier.

If plier sheath 10 is not attached to knife sheath 14, the loop of straplike portion 40 may be formed and locked to that position around belt 26 for removably attaching plier sheath 10 to belt 26. Thus, if knife 21 is not necessary, knife sheath 14 and knife 21 may be removed from the belt to be left behind without depriving the carrier of the opportunity to carry his pliers in a convenient fashion. Therefore, the plier sheath of the present invention may be removably attached not only to knife sheath 14 but also to belt 26 directly, thus eliminating the inconvenience and the unnecessary hazard of carrying knife 21 if it is not needed.

Figure 4:
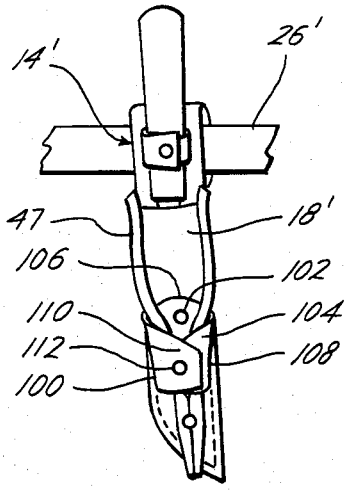
FIG. 4 is a front view of another embodiment of the plier sheath of the present invention.

FIG. 4 shows another embodiment of the plier sheath of the present invention. There is shown a plier sheath 100 which is removably or permanently attached to knife sheath 14' by attachment means 102, which may comprise one or more snap fasteners or rivets, for example. Knife sheath 14' which is also attached to a belt 26' is similar to knife sheath 14 described in the previous embodiment, but may differ somewhat in the location of attachment means on the sheath panels 18, 18' to accommodate the different sized plier sheaths 10, 100. Plier sheath 100 comprises a lower, generally rectangular portion 104 and an upper, generally triangular portion 106 extending upwardly from rectangular portion 104. Side ends 108, 110 of rectangular portion 104 are folded over inwardly to form a pocket for pliers 47 and are releasably or permanently interconnected by snap fastening or riveting means 112.

The small size of plier sheath 100 and its attachment to the outside of knife sheath 14 result in a multiple tool carrier that is small, practical and convenient to carry. Furthermore, when removably attached to knife sheath 18', it allows one who does not wish to use or carry the pliers to remove plier sheath 100 from knife sheath 14'.

While preferred embodiments of the invention have been shown and described, modifications thereof can be made by one skilled in the art without departing from the spirit of the invention.

What is claimed is:

1. A first tool holder for use in conjunction with a second tool holder, the second tool holder being removably attachable to a person's clothing, comprising:

a sheath body;

pocket means disposed on said sheath body for receiving and supporting a first tool; and means disposed on said sheath body for superimposingly attaching the first tool holder to said second tool holder, said sheath body in unassembled form including a flat panel of flexible material, said flat panel including a lower, generally rectangular portion and a generally triangular portion extending upwardly from said rectangular portion, the side ends of said rectangular portion in assembled form being folded over fowardly and inwardly and interconnected, thereby forming said pocket means as a tapered pocket with an open bottom for receiving and supporting the first tool therewithin.

2. A first tool holder according to claim 1 wherein said attaching means includes snap fasteners disposed on the back of said sheath body for connecting said sheath body to correlatively shaped snap fasteners disposed on the outside surface of the second tool holder.

3. A first tool holder according to claim 1 wherein said attaching means includes a rivet through the back side of said sheath body and the front side of such second tool holder.

4. A first tool holder for use in conjunction with a second tool holder, the second tool holder being removably attachable to a person's clothing, comprising:

a sheath body;

pocket means disposed on said sheath body for receiving and supporting a first tool;

means disposed on said sheath body for superimposingly attaching the first tool holder to said second tool holder; and means disposed on said sheath body for removably attaching the first tool holder to a person's clothing, said sheath body in unassembled form including a flat panel of flexible material, said flat panel including a generally rectangular lower portion having two side ends, a generally triangular intermediate portion extending upwrdly from said rectangular portion and a straplike upper portion extending upwardly from said triangular portion, said side ends of said rectangular portion in assembled form being folded over and connected to each other thereby forming a pocket with an open bottom for supporting a first tool therewithin.

5. A first tool holder according to claim 4 wherein said means for superimposingly attaching the first tool holder to the second tool holder includes a first snap portion disposed on the back of said rectangular lower portion of said flat panel and a second snap portion disposed on the back of said straplike portion of said flat panel when said straplike portion is in assembled form, i.e., folded over toward the back of said sheath body and attached thereto to form a loop, said first and second snap portions being adopted for releasable connection to correlatively shaped snap portions disposed on the outside surface of such second tool holder.

6. A first tool holder according to claim 4 wherein said means of removably attaching the first tool holder to a person's clothing include a loop comprising said straplike portion of said flat panel folded downwardly and rearwardly, said loop being closed by a first fastener element disposed on the back side of the free end of said straplike portion connected to a second, correlatively shaped fastener element disposed at about the middle of the back side of said triangular intermediate portion.

7. A plier sheath which can be attached to a knife sheath, the knife sheath being removably attachable to a person's belt, comprising:

a flat panel of flexible material which in unassembled form includes a generally rectangular lower portion, a generally triangular intermediate portion extending upwardly from said rectangular portion, and a straplike upper portion extending upwardly from said triangular portion, the side ends of said rectangular portion in assembled form being folded over forwardly and inwardly thereby forming a tapered pocket with an open bottom for receiving and supporting a pair of pliers therewithin, said side ends being connected to each other;

two female snap members, the first female snap member being located on the back of the rectangular portion of said flat panel and the second female snap member being located on the front of the straplike portion of said flat panel when said flat panel is in unassembled form, said second female snap member facing towards the back when said straplike portion is in its assembled form folded over toward the back of said flat panel, said female snap members corresponding to male snap members disposed on the outside surface of such knife sheath for superimposingly attaching said plier sheath on such knife sheath;

means for removably attaching said plier sheath to a person's belt, said means including a loop comprising said straplike portion of said flat panel folded downwardly and rearwardly, said loop being closed by a fastener element disposed upon the back of the upper end of said straplike portion and a corresponding fastener element disposed upon the back of said triangular portion.

* * * * *